US006935523B2

(12) United States Patent
Ahn

(10) Patent No.: US 6,935,523 B2
(45) **Date of Patent: *Aug. 30, 2005**

(54) MODULAR DISPLAY RACK SYSTEM

(75) Inventor: Chong Youn Ahn, Redondo Beach, CA (US)

(73) Assignee: LA Display Fixture, Inc., Los Angeles, CA (US)

( * ) Notice: Subject to any disclaimer, the term of this patent is extended or adjusted under 35 U.S.C. 154(b) by 147 days.

This patent is subject to a terminal disclaimer.

(21) Appl. No.: 10/421,524

(22) Filed: Apr. 22, 2003

(65) Prior Publication Data

US 2003/0196980 A1 Oct. 23, 2003

Related U.S. Application Data

(63) Continuation-in-part of application No. 10/117,572, filed on Apr. 4, 2002, now Pat. No. 6,669,037

(60) Provisional application No. 60/349,940, filed on Jan. 18, 2001.

(51) Int. Cl.[7] ..... A47F 5/00

(52) U.S. Cl. ..... 211/195; 211/189; 211/206; 211/193; 280/79.3

(58) Field of Search ..... 211/189, 190, 211/193, 182, 206, 103, 195; 280/79.3; 248/188.6, 170

(56) References Cited

U.S. PATENT DOCUMENTS

| | | | | | |
|---|---|---|---|---|---|
| 2,793,764 | A | * | 5/1957 | Stork | 211/204 |
| 2,893,568 | A | * | 7/1959 | Scholz | 211/204 |
| 3,212,648 | A | | 10/1965 | Baker et al. | |
| 3,512,654 | A | | 5/1970 | Olsen et al. | |
| 3,602,374 | A | | 8/1971 | Alabaster | |
| 3,730,108 | A | | 5/1973 | Stroh | |
| 3,871,784 | A | | 3/1975 | Van Horn | |
| 3,937,329 | A | | 2/1976 | Hammerel | |
| 4,397,432 | A | * | 8/1983 | Resetar | 244/118.6 |
| D327,993 | S | | 7/1992 | Brunner | |
| 5,535,898 | A | * | 7/1996 | Burgess et al. | 211/206 |
| 5,617,962 | A | * | 4/1997 | Chen | 211/206 |
| 5,653,349 | A | | 8/1997 | Dana et al. | |
| 5,660,637 | A | | 8/1997 | Dodge | |
| 5,718,344 | A | * | 2/1998 | Joldeson et al. | 211/206 |
| 5,779,065 | A | | 7/1998 | Thalenfeld et al. | |
| 5,887,731 | A | | 3/1999 | Thalenfeld | |
| 5,894,945 | A | | 4/1999 | Curran | |
| 6,029,833 | A | | 2/2000 | Yeh | |
| 6,129,224 | A | | 10/2000 | Mingers | |
| 6,240,687 | B1 | | 6/2001 | Chong | |
| 6,561,366 | B2 | | 5/2003 | Kim-So | |
| 6,669,037 | B1 | * | 12/2003 | Ahn | 211/189 |
| 6,669,213 | B2 | * | 12/2003 | Woerner | 280/47.35 |
| 2003/0034320 | A1 | | 2/2003 | Noh | |

* cited by examiner

*Primary Examiner*—Robert W. Gibson, Jr.
(74) *Attorney, Agent, or Firm*—Christie, Parker & Hale, LLP

(57) ABSTRACT

Modular display rack systems, which are easily configurable, have interchangeable components, and are capable of being packaged and shipped in small containers, are described. Preferred methods for using modular display rack systems are also disclosed. In some of the embodiments disclosed, one or more ladder racks are used to erect a single tower modular display rack, a two tower modular display rack and so forth. Each ladder rack used to construct the modular display rack system may include a support base pivotally attached via a pivot pin to a lower portion of the ladder rack. The support base supports the load of the ladder rack and the modular display rack system and also pivots to a folded position if desired.

28 Claims, 14 Drawing Sheets

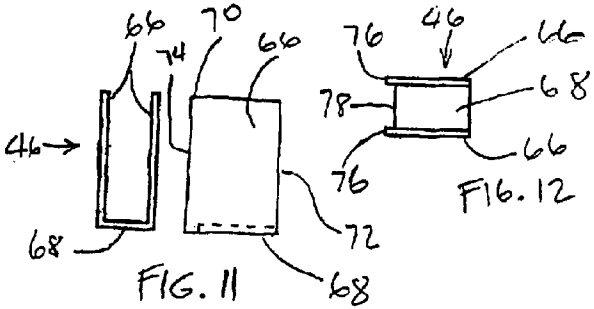
FIG. 11
FIG. 12
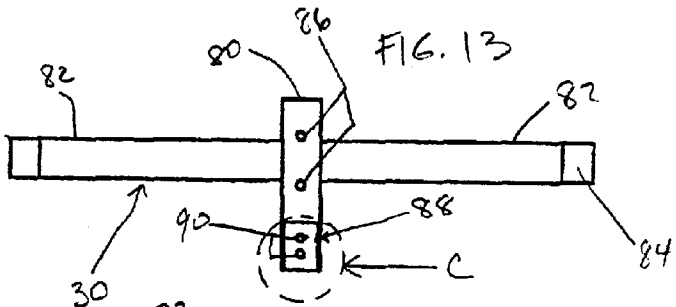
FIG. 13
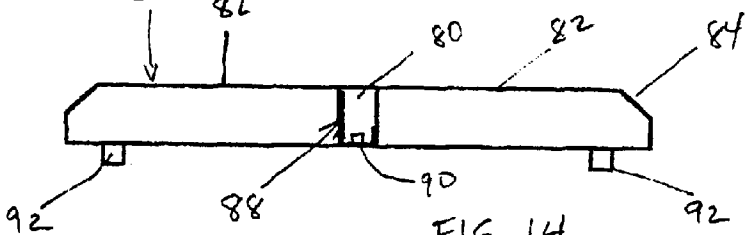
FIG. 14
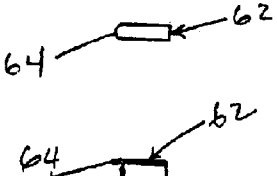
FIG. 10
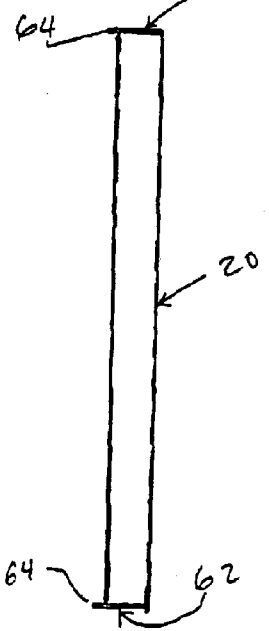
FIG. 9
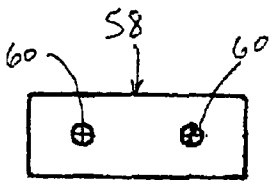
FIG. 8

MODULAR DISPLAY RACK SYSTEM

CROSS-REFERENCE TO RELATED APPLICATION

The present continuation-in-part application claims the benefit of application Ser. No. 10/117,572, filed on Apr. 4, 2002, now U.S. Pat. No. 6,669,037 which claims the benefit of provisional application No. 60/349,940, filed on Jan. 18, 2001, both entitled "MODULAR DISPLAY RACK SYSTEM", their contents are expressly incorporated herein by reference.

Modular display racks discussed herein generally relate to display racks for displaying merchandise items and, more specifically, to modular display racks that may be assemble and disassemble into different configurations.

BACKGROUND

Display racks having one or multiple display ladders are widely used in retail shops and departments stores to display merchandise such as clothing, toys, and food. FIG. 1 is a semi-schematic isometric drawing of a prior-art ladder style display rack. Ladder style display racks, such as that shown in FIG. 1, are generally designed to be used with hangrail brackets 11 and shelf brackets (not shown). These hangrail brackets 11 and shelf brackets (not shown) engage the individual ladder steps 2 and provide extensions (similar to a shelf or an arm) to which hangers and folded clothing may be hung or spread out for display.

There are several disadvantages with the illustrated prior art display rack 1. Among other things, the prior art display rack includes a welded upper rack portion 3 and a welded lower base portion 4. The welded upper portion 3 includes ladders 5 joined together by a plurality of lateral support bars 6. Because the joints between the lateral support bars 6 and the ladders 5 are welded, the upper portion 3 may be often quite large and heavy depending on the number of ladders used.

The base portion 4 may similarly be imposing to an individual handling and shipping the rack assembly 1. The base portion 4 includes two end stabilizer bars 7 joined together by a cross-bar 8. The end stabilizer bars 7 are usually also equipped with casters 9. Thus, packaging and finding available couriers to transport the prior art rack system 1 may be burdensome.

Another deficiency with the illustrated prior art display rack 1 is that the welded joints between the stabilizer bars 7 and the ladders 5 may sometime crack or break due to the overall weight of the rack system 1. In addition, due to the reasons discussed above, the rack system 1 may overall be heavy and difficult to manipulate. Furthermore, each configuration of the ladder rack system (i.e., a single ladder rack, a two ladder rack, a three ladder rack, and on occasions, a four ladder rack) requires separate inventory and production. This may be both expensive to produce and more difficult to minimize inventory. Among other things, several production procedures may be required for different rack configurations, making production more costly. Also, predicting which rack configuration to store may not be easy since the configuration that a customer is most likely to order may generally not be predicted. This may lead to the production and storage of multiple rack system with different configurations.

Accordingly, there remains a need for a modular display rack that is easily modifiable into different configurations. Such a modular display rack should, to the extent possible, be easier to assemble and disassemble then the display racks in the prior art.

SUMMARY

From a rack manufacturer's standpoint, display racks that are easy to assemble and disassemble have additional benefits. Racks of this type simplify inventory and are easier to package and ship via carriers such as UPS® and Federal Express®. In addition, modular racks that are capable of reducing into smaller components are easier to handle and require fewer workers and machines to manipulate. Such manipulation includes removing the components from their shelves and then packaging them for shipping.

Accordingly, the present invention utilizes detachable members to form a base and then permit individual components to removeably mount thereto to form a modular rack. To disassemble the modular rack into smaller components, the steps are simply reversed.

The modular rack can be installed as a single tower rack or as a rack of any tower size, limit only by the display area, by the addition or removal of the modular components such as the center stabilizer bars, removable cross-bars, center ladders, and lateral support bars.

The modular rack in accordance with practice of the present invention may include two ladder racks removably connected together by an upper horizontal bar and a lower horizontal bar, the two ladder racks each comprises two vertical braces and a base bar pivotally attached to a lower end of the two vertical braces via a pivot pin; and wherein the base bar is pivotable between a first position and a second position about the pivot pin.

Another modular display rack system provided in accordance with aspects of the present invention for displaying merchandise items may comprise a first end ladder rack comprising a first vertical brace having an inwardly facing surface and an outwardly facing surface and a second vertical brace having an inwardly facing surface and an outwardly facing surface; a plurality of cross braces connected to the inwardly facing surfaces of the first and second vertical braces of the first end ladder rack; a retaining aperture located on a lower portion of the inwardly facing surface of each of the first and second vertical braces; a base bar for supporting the first end ladder rack pivotally attached to the retaining aperture of each of the first and second vertical braces via a pivot pin; the base bar is moveable between a first position and a second position about the pivot pin; and wherein the first end ladder rack is removably attached to a second end ladder rack or a center ladder rack by a support bar, the support bar supporting the first end ladder rack and either the second end ladder rack or the center ladder rack laterally.

Still yet, another aspect of the prevention invention includes a method for erecting a modular display rack comprising attaching a first end ladder rack to either a second end ladder rack or a center ladder rack using support bar; the first end ladder rack comprising two vertical braces attached to one another by a plurality of cross braces; moving a base bar pivotally attached to the end ladder rack via a pivot pin from a first position to a second position; and fixing the base bar from pivotally rotating from the second position.

Other embodiments and variations may be implemented based on teachings of the disclosure and the drawings set forth herein.

BRIEF DESCRIPTION OF THE DRAWINGS

These and other features, aspects, and advantages of the present invention will become better understood with regard to the following description, appended claims, and accompanying drawings where:

FIG. 8 is a top plan view of a base bracket of detail A in FIG. 5;

FIG. 9 is a side elevation view of a lateral support bar;

FIG. 10 is a side elevation view of a flange mounted to the lateral support bar of FIG. 9;

FIG. 11 is a front and side elevation view of a U-shape bracket of detail B in FIG. 6;

FIG. 12 is a top plan view of the U-shape bracket of FIG. 11;

FIG. 13 is a top plan view of an end stabilizer bar in accordance with practice of the present invention;

FIG. 14 is a side elevation view of the end stabilizer bar of FIG. 13;

DETAILED DESCRIPTION

The detailed description set forth below in connection with the appended drawings is intended as a description of the presently preferred embodiments of the modular display rack in accordance with the present invention and is not intended to represent the only forms in which the present invention may be constructed or utilized. The description sets forth the features and the steps for constructing and using the modular display rack of the present invention in connection with the illustrated embodiments. It is to be understood, however, that the same or equivalent functions and structures may be accomplished by different embodiments that are also intended to be encompassed within the spirit and scope of the invention. Also, as denoted elsewhere herein, like element numbers are intended to indicate like or similar elements or features.

Figure 1:
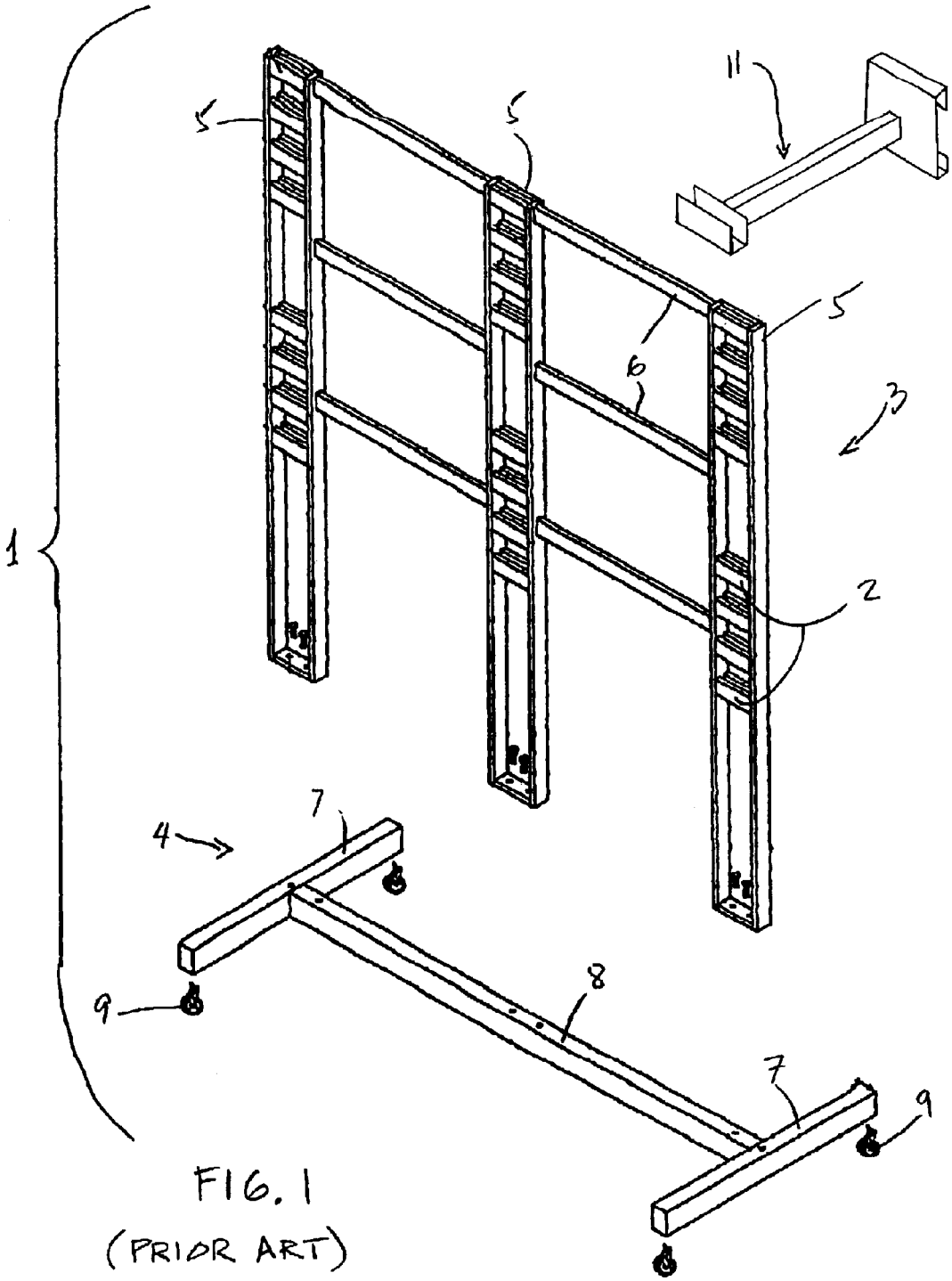
FIG. 1 (PRIOR ART)
FIG. 1 is a semi-schematic isometric drawing of a prior art display rack.
Figure 2:
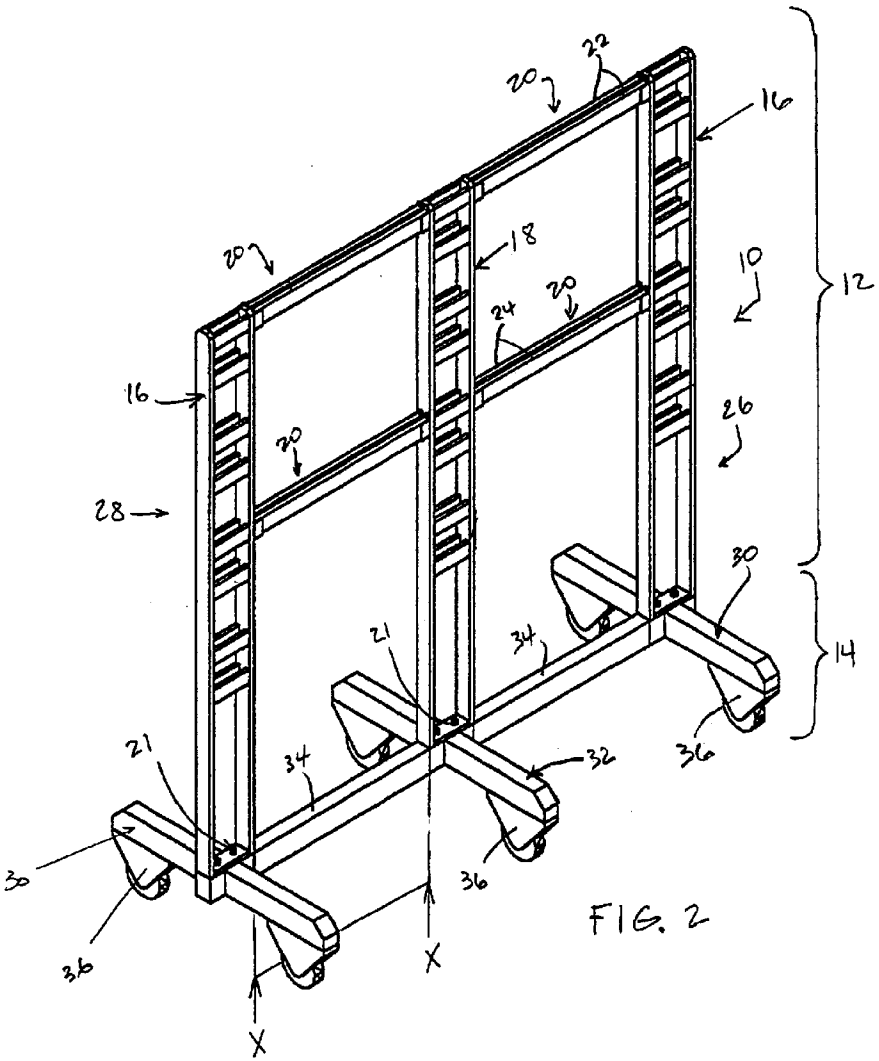
FIG. 2 is a semi-schematic isometric drawing of a modular display rack in accordance with practice of the present invention.

Referring now to FIG. 2, there is shown an embodiment of a triple tower or a three-ladder modular display rack (hereinafter "display rack"), generally designated 10. According to one embodiment, the modular display rack 10 may be disassembled into smaller components, allowing it to be portable and modular than prior art systems. The modular architecture of the display rack 10 allows it to be boxed up in small packages, assembled into a single ladder rack or multiple ladder racks, and inventoried by components instead of rack configurations since the single, double, and triple ladder racks do not have to be kept separately.

The display rack 10 according to the embodiment illustrated in FIG. 2 includes an upper rack portion 12 and a lower base portion 14. For a three-ladder rack system 10, the upper rack portion 12 includes two end ladders 16 and a center ladder 18. Assuming the vertical direction is the lengthwise direction and the horizontal direction is the direction of width of the ladder, the end and center ladders 16, 18 are interconnected by a plurality of removable lateral support bars 20 along the horizontal direction and to the base in the vertical direction, by a plurality of fasteners 21. In an exemplary embodiment, there is an upper pair of lateral support bars 22 and a lower pair of lateral support bars 24. These lateral support bars 22, 24 are removeably connected to the ladders by a detent-like arrangement. Each individual pairs of lateral support bars permit hangrail brackets 11 and shelf brackets (not shown) to be hung on either a first side 26 and/or a second side 28.

The lower base portion 14 includes two end stabilizer bars 30, a center stabilizer bar 32, and two removable cross-bars 34 used to removeably connect the two end stabilizer bars 30 with the center stabilizer bar 32. Each stabilizer bar 30, 32 is also equipped with casters 36, which may be fixed or rail type casters. However, other casters may be used such as swivel stem style casters with breaks and locks. If used, these swivel stem style casters prevent the display rack 10 from moving when pushed accidentally. The stem style casters may screw or thread directly into the stabilizer bars 30, 32, or, alternatively, thread into corresponding nuts (not shown) welded to the base of the stabilizer bars. Other casters and methods for installing the same are conventional in the art and may also be used as will be apparent to one skilled in the art.

Figure 3:
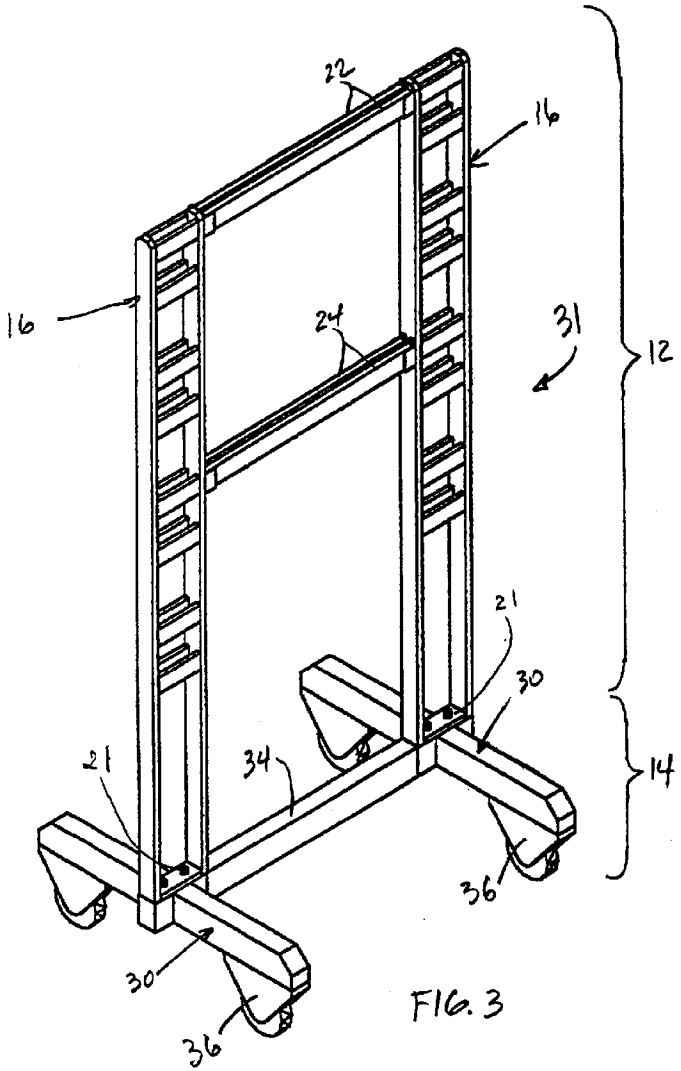
FIG. 3 is a semi-schematic isometric drawing of the modular display rack of FIG. 1 in a double ladder configuration.

Referring now to FIG. 3, there is shown a double tower or a two-ladder modular display rack 31. Like the display rack of FIG. 2, the modular display rack 31 comprises an upper rack portion 12 and a lower base portion 14. The upper rack portion 12 includes two end ladders 16 removeably secured to the base in the vertical direction by several fasteners 21. The two removable end ladders 16 are attached to each other by an upper and a lower pair of lateral support bars 22, 24.

The lower base portion 14 includes two end stabilizer bars 30 removeably secured to each other by a single cross-bar 34. The lower base portion 14 also includes a plurality of casters 36, which may be fixed or rail type casters. However, as discussed above, other casters may be used such as swivel stem style casters with breaks and locks.

As readily apparent to a person of ordinary skill in the art, the double tower display rack 31 is a subcombination of the triple tower display rack shown in FIG. 2. To create the double tower display rack 31 from the triple tower display rack 10, the center ladder 18, the two pair of lateral support bars 22, 24, the center stabilizer bar 32, and one of the removable cross-bars 34 are removed from the triple tower rack 10. Conversely, to assemble a multiple tower rack, such as a four tower rack or higher, additional center ladders 18, cross-bars 34, and lateral support bars 20, collectively referred to as rack components, are added. This eliminates the need for the advance production and storage of pre-welded multiple tower racks. Racks of different configurations may now be created via the addition or the removal of the rack components.

Figure 4:
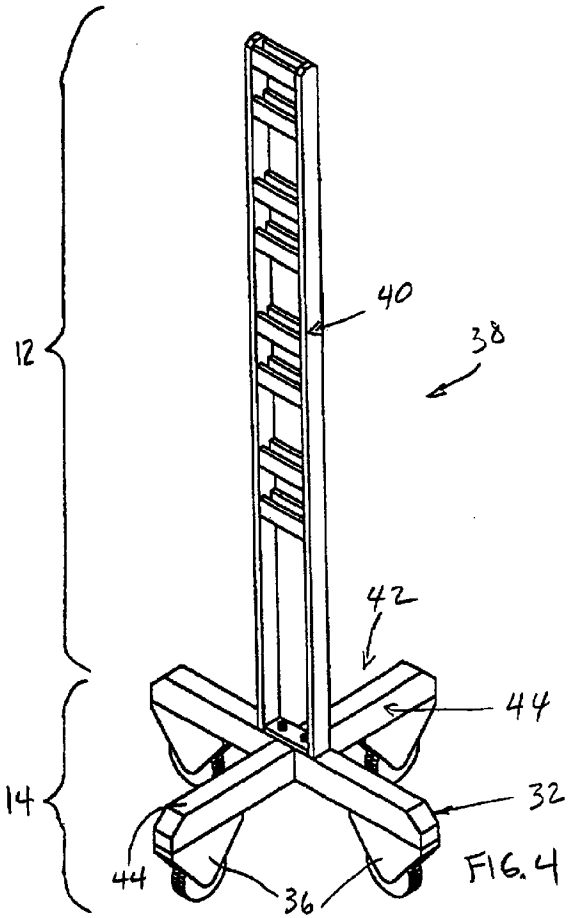
FIG. 4 is a semi-schematic isometric drawing of the modular display rack of FIG. 1 in a single ladder configuration.

Referring now to FIG. 4, there is shown and described a single tower or a single ladder display rack 38 in accordance with practice of the present invention. The single ladder display rack 38 comprises an upper rack portion 12 and a lower base portion 14. The upper rack portion 12 includes a slightly modified single unit ladder 40. It is slightly modified with respect to the end ladder 16 and the center ladder 18 of FIGS. 2 and 3. As further discussed below, the single unit ladder 40 may be similar to the end and center ladders 16, 18 except for the lack of side mounted U-shape brackets. However, for ease of inventory or the minimization of components, an end ladder 16 or a center ladder 18 may be used in place of the single unit ladder 40 to provide the same overall functionality.

The lower base portion 14 of the single ladder display rack 38 includes a single cross-style base 42. To minimize the number of different components, the cross-style base 42 may be assembled by removeably securing two half-bars 44 onto the center stabilizer bar 32. Accordingly, one component used for the single tower that may not be present in the double tower and the triple tower rack is the half-bars 44 used in the single cross-style base 42.

The cross-style base 42 also utilizes a plurality of casters 36. As discussed above, these casters may be a fixed type, a flanged type, a swivel type and the like. Accordingly, minor changes between caster types are contemplated to fall within the spirit and scope of the present invention.

Figure 5A:
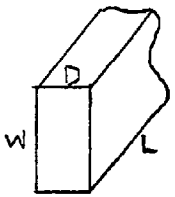
FIG. 5 is a front and side elevation view of an end ladder in accordance with practice of the present invention.
Figure 5:
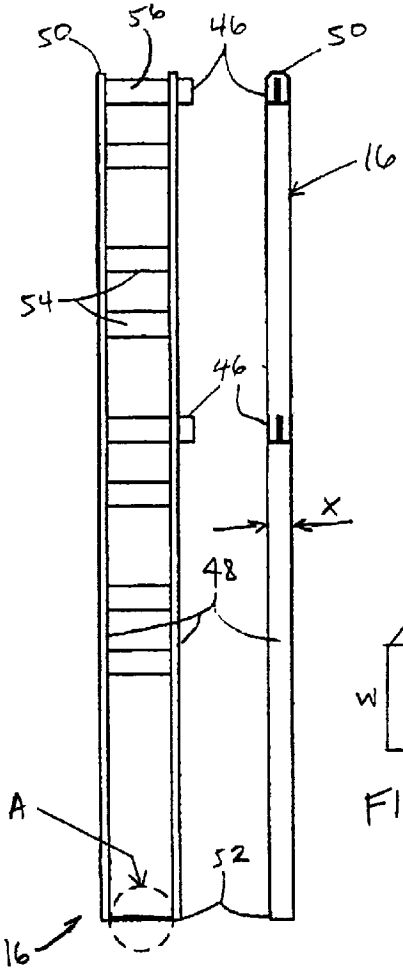

FIGS. 5–19 are now referred for a detailed description of the various components embodied in the display racks of FIGS. 2–4. Specifically, FIG. 5 is a semi-schematic diagram of the end ladder 16 of FIGS. 2 and 3. According to one embodiment of the invention, the end ladder 16 includes a pair of U-shape brackets 46. The end ladder 16 also includes a pair of vertical braces 48 taking the form of rectangular tubing pieces. The upper end 50 of each vertical brace 48 may be machined, rolled, or extruded (collectively "machined") with a smooth finish for aesthetic appeal and for eliminating sharp edges. This upper end 50 may be shaped in a half-dome, half arrow, or any other shapes helping to eliminate sharp edges and providing a minimum aesthetic appeal. The lower end 52, because it braces onto a stabilizer bar, is machined with a flat finish.

The pair of vertical braces 48 is fixedly secured together by a plurality of cross-braces 54. The number of cross-braces in the ladder 16 depends on the length of the ladder. The vertical braces 48 and the cross braces 54 have the following configuration: L×W×D, where L is the length, W is the width, and D is the depth of the rectangular tubing (FIG. 5A). In an embodiment where each vertical brace 48 has a width X, each of the cross-braces 54, which may also be made from rectangular tubing pieces, have a depth that is less than half X. This provides, at each cross-brace to vertical brace welded location, space for accommodating a pair of cross-braces 54. In other words, at the top cross-brace location 56, two cross-braces 54, one superimposed over the other but separated by a small gap, are welded to the pair of vertical braces 48. Thus, two times the depth of the cross-brace plus the small gap should be the same as or slightly less than the width of the vertical brace 48. Exemplary dimensions are further discussed below.

Figure 6:
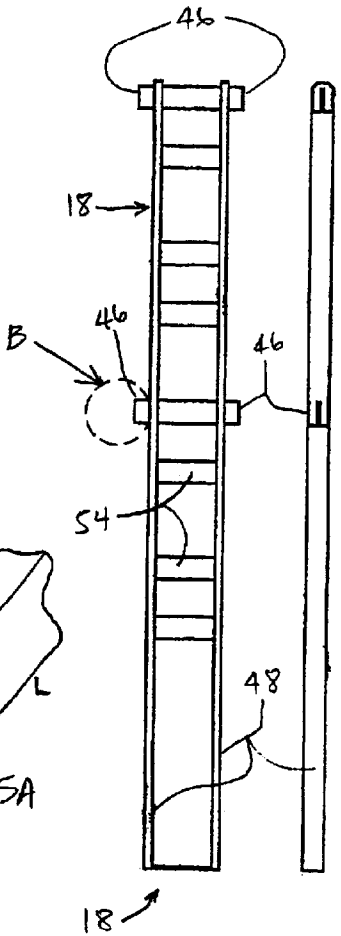
FIG. 6 is a front and side elevation view of a center ladder in accordance with practice of the present invention.

Referring now to FIG. 6, there is shown and described a center ladder 18 in accordance with practice of the present invention. The center ladder 18 may be similar to the end ladder 16 except that the center ladder includes two sets of U-shape brackets 46 on each side of the vertical brace 48. This allows the center brace 18 to be used in the center of any multiple ladder arrangements and be used to join adjacent ladders together by way of removeably securing lateral support bars to the U-shape brackets 46.

Figure 7:
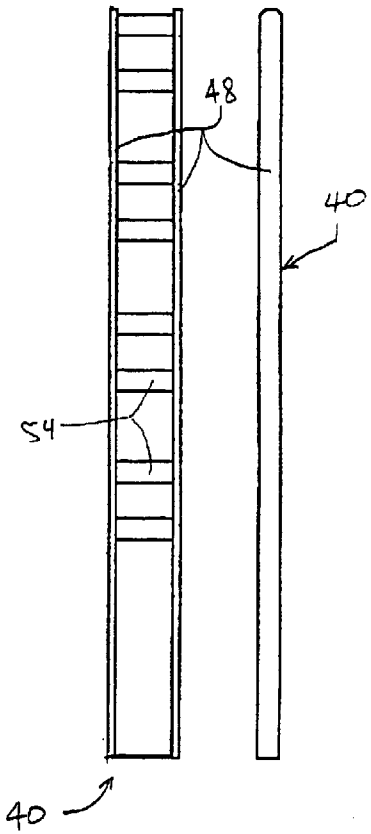
FIG. 7 is a front and side elevation view of a single unit ladder in accordance with practice of the present invention.

Referring now to FIG. 7, a single unit ladder 40 is shown and described. The single unit ladder 40 may be similar to the end ladder except for the lack of U-shape brackets welded to the vertical braces 48. The U-shape brackets are not included in the single unit ladder 40 since it is used as a stand-alone tower rack, and not contemplated to be expanded into other configurations.

Although the end, center, and single unit ladders of FIGS. 5, 6, and 7 are shown having a particular dimension with a particular number of cross-braces, a person skilled in the art should recognize that alternative dimensions and alternative number of cross-braces may also be used. The dimensions and number of cross-braces may also be customizable based on needs and requests of merchants and customers. Similarly, instead of welding a pair of cross-braces at each of the cross-brace to vertical brace location or using a U-shape bracket (for allowing hangrail brackets 11 and shelf brackets (not shown) to be mounted on either a first side 26 and/or a second side 28 of the rack), a single cross-brace and/or a single U-shape bracket may be used. If so, for a particular attachment location, only a single hangrail, a single shelf bracket, or a single removable lateral support bar may be used.

Referring now to FIG. 8, there is shown and described a base bracket 58, which is a blown up view of detail A indicated in FIG. 5. According to one embodiment, the base bracket 58 is a flat steel plate having two through holes 60 machined therein. The base bracket 58 is fixedly secured to the vertical braces 48 by any number of known welding methods, including arc welding, brazing, and resistance welding. The two through holes 60 allow a pair of fasteners 21 to be inserted therethrough and to tighten the ladder against a stabilizer bar such as, stabilizer 30 or 32. It is understood that any number of welding methods apply whenever the term "weld", "welded", or "welding" is used.

Referring to FIGS. 9 and 10, there is shown and described an exemplary lateral support bar 20, which can be the upper 22 or the lower lateral support bar 24. The lateral support bar can be made from a rectangular tubing piece and is welded on each end by a flange 62. The flange 62 includes an engagement tip 64 configured to engage a U-shape bracket 46 in a detent-like fashion. The flange 62 may be made from a flat steel plate.

Referring now to FIGS. 11 and 12, there is shown and described an exemplary U-shape bracket 46, which is a blown up view of detail B indicated in FIG. 6. According to one embodiment, the U-shape bracket 46 is a steel channel having two sides 66 and a base 68. Each of the two sides 66 comprises a square finish 70 or a rounded finish, a first open face 72, and a rear attachment face 74. The open face 72 allows a lateral support bar 20, when set in position, to slide in-between the two sides 66 and rest on top of the base 68. Conversely, the rear attachment face 74 is configured to be welded to a main vertical brace 48 by its two end surfaces 76 (FIG. 12). As indicated, the base 68 terminates short of the rear attachment face 74 to form a receiving channel 78. Accordingly, when a lateral support bar 20 is set in position inside the U-shape bracket 46, the receiving channel 78 provides an opening or a gap for the engagement tip 64 located on the flange 62, which, as discussed, is located on each of the ends of the lateral support bar 20 (FIG. 9). Accordingly, the engagement tip 64 and the receiving channel 78 interact to removeably secure one ladder with another ladder (such as securing one end ladder 16 to a center ladder 18).

In an exemplary embodiment, two U-shape brackets 46 are welded, side-by-side, to the main vertical brace 48. In this fashion, the two U-shape brackets 48 may accommodate two lateral support bars 20 in a side-by-side fashion to provide two hanging surfaces for hangrails 11 and the like. In order to allow sufficient space for the engagement end of the hangrail to engage the lateral support bar 20, the two U-shape brackets 46 may be welded with a flat plate (not shown) disposed therebetween. According to one embodiment, this plate serves to not only add structural rigidity to the two U-shape brackets, but also fix or define a gap in-between the U-shape brackets to enable the engagement end of the hangrail 11 to grab onto.

Referring now to FIGS. 13 and 14, there is shown and described an end stabilizer bar 30, also referred to as a base bar, in accordance with practice of the present invention. The end stabilizer bar 30 includes two leg extension pieces 82 welded to a center load-bearing piece 80. Again, all three pieces, the two leg extension pieces 82 and the center load-bearing piece 80, may be made from rectangular tubing. In an exemplary embodiment, at the end 84 of each leg extension 82, a tapered or slanted finish 84 is provided. This serves to both beautify the ends of the stabilizer bar 30 and eliminate sharp edges.

In the illustrated embodiment, the center load-bearing piece 80 includes two through holes 86. These through holes 86, which extend the entire width of the center load bearing piece, are positioned so that when an end ladder 16 is mounted to the end stabilizer bar 30 by, for example, positioning the base bracket 58 directly over the center load bearing piece 80, the through holes 86 align with the through holes 60 on the base bracket 58. After the through holes 60, 86 are aligned, a pair of fasteners 21, such as a pair of bolt and nut combination, may be inserted therethrough and tightened. A person skilled in the art should recognize that any other number of through holes may be used depending on the width of the center load bearing piece and the dimension of the holes.

A joining bracket 88 is provided which is welded to one of the axial ends of the center load-bearing piece 80. A pair of nuts 90 are also provided and welded onto the joining bracket 88 to serve as gripping points for a pair of bolts (not shown). Thus, to join two end stabilizer bars 30 (or one end stabilizer bar 30 and one center stabilizer bar 32) together, a removable cross-bar 34 is placed over the joining bracket 88 in a telescoping fashion. A pair of bolts (not shown) are then inserted and tightened against the pair of nuts 90 to thereby removeably secure the cross-bar 34 to the end stabilizer bar 30. As discussed above, the lower base portion 14 may be practiced with swivel type casters. When that is the case, the two leg extensions 82 are fitted or welded with a pair of swivel nuts 92. The swivel type casters can then thread or screw directly into the swivel nuts 92 to be removeably secured the casters thereto.

Figure 16:
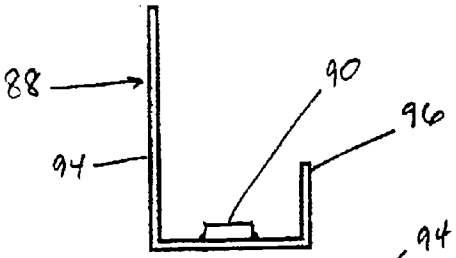
FIG. 16 is a side elevation view of the joining bracket of FIG. 15.
Figure 15:
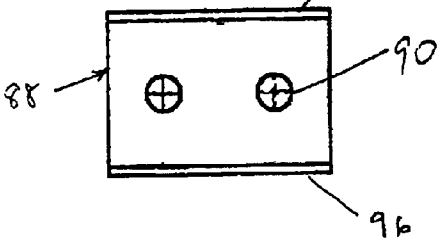
FIG. 15 is a top plan view of a joining bracket of detail C in FIG. 13.

Referring now to FIGS. 15 and 16, there is shown and described the joining bracket 88 discussed in reference with FIGS. 13 and 14, which are blown up drawings of detail C in FIG. 13. In the illustrated embodiment, the joining bracket 88 is an extended L-shape bracket that includes a first tall side 94 and a second short side 96. The second short side 96 allows access to the central portion where the nuts 90 can be welded to the bracket. In addition, because the joining bracket 88 is designed to fit into one of the ends of a removable cross-bar 34 in a telescoping fashion, the second shorter side 96 has the effect of reducing drag or friction as the removable cross-bar 34 engages the joining bracket 88. Thus, because of the telescoping style arrangement, it is understood that the joining bracket 88 has a smaller cross-sectional area than the cross-sectional area of the cross-bar. A person skilled in the art should recognize, however, that instead of a tall side and a short side, two tall sides may be used to render a U-shape bracket.

Figure 17:
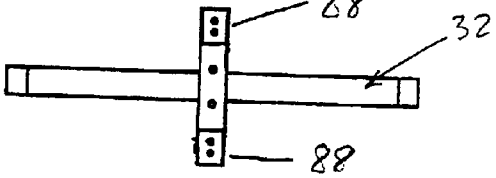
FIG. 17 is a top plan view of a center stabilizer bar in accordance with practice of the present invention.

Referring now to FIG. 17, there shown and described a top plan view of the center stabilizer bar 32 of FIG. 2. The center stabilizer bar 32 may be similar to the end stabilizer bar 30 except that the center stabilizer bar includes two joining brackets 88 instead of one. This enables the center stabilizer bar 32 to be used in-between two end stabilizer bars 30 and be connected on each side by a removable cross-bar 34.

Figure 18:
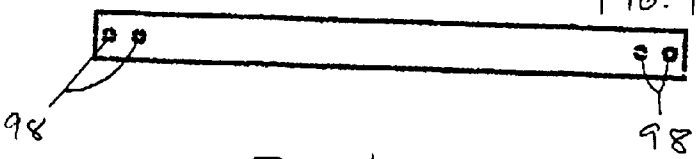
FIG. 18 is a bottom plan view of a removable cross-bar of FIG. 2 taken at line X—X.

Referring now to FIG. 18, there is shown and described a removable cross-bar 34 taken along reference line X—X of FIG. 2. According to one embodiment, the removable cross-bar 34 is made from rectangular tubing and is drilled on both ends with a pair of holes 98. The holes are configured so that they align with the pair of nuts 90 welded to the joining bracket 88 (FIG. 15). Accordingly, when the removable cross-bar 34 is slid over the joining bracket 88 in a telescoping fashion, the holes 98 align with the nuts 90 on the joining bracket 88. In this fashion, a pair of bolts may then be inserted to removeably secure the cross-bar 34 with one of the end stabilizer bars 30 or one of the center stabilizer bars 32.

Figure 19:
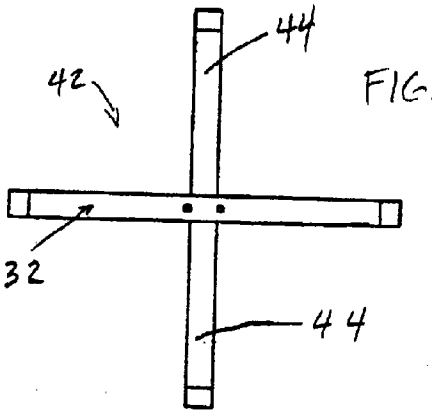
FIG. 19 is a top plan view of a cross-style base of FIG. 4.

Referring now to FIG. 19, there is shown and described a top plan view of the cross-style base 42 of FIG. 4. The cross-style base 42 may be a center stabilizer bar 32 with two half-bars 44 mounted in a telescoping fashion with the two joining brackets 88. Alternatively, the joining brackets 88 may be eliminated altogether by welding two half-bars 44 directly onto the center stabilizer bar 32. This alternative method will produce a cross-style base 42 that is permanently fixed.

In general terms, a multi-tower rack may be assembled in the following fashion with reference to FIGS. 2–4. In assembling the lower base portion 14, two end stabilizer bars 30 are fastened with one center stabilizer bar 32 for creating a three-tower rack. A cross-bar 34 is slid over the joining bracket 88 of the end stabilizer bar 30 and tightened with a pair of bolts at the cross-bar holes 98. The other end of the cross-bar 34 is then slid over the joining bracket 88 of the center stabilizer bar 30 and then tightened with another pair of bolts. This is then repeated on the other side with another end stabilizer bar 30 and another cross-bar 34 to form the base. After the lower base portion 14 is assembled, it may be disassembled by reversing the steps.

In assembling the upper rack portion 12, two end ladders 16 are fastened on the two end stabilizer bars 30 by inserting a pair of bolts at the base bracket 58 through the through holes 86 of each end ladder 16. The U-shape brackets 46 on each of the end ladders 16 are turned so that they face inward, toward the center stabilizer bar 32. In the same fashion, a center ladder 18 is mounted over the center stabilizer bar 32. Eight lateral support bars 20 are then used to removeably secure the two end ladders 16 with the center ladder 18. This is done by lowering the flange ends 62 of the lateral support bars into corresponding pair of U-shape brackets 46. The engagement tips 64 of the various flanges 62 should slide into their respective receiving channels 78. Once the upper rack portion 12 is assembled, it may be disassembled by reversing the steps.

Figure 20:
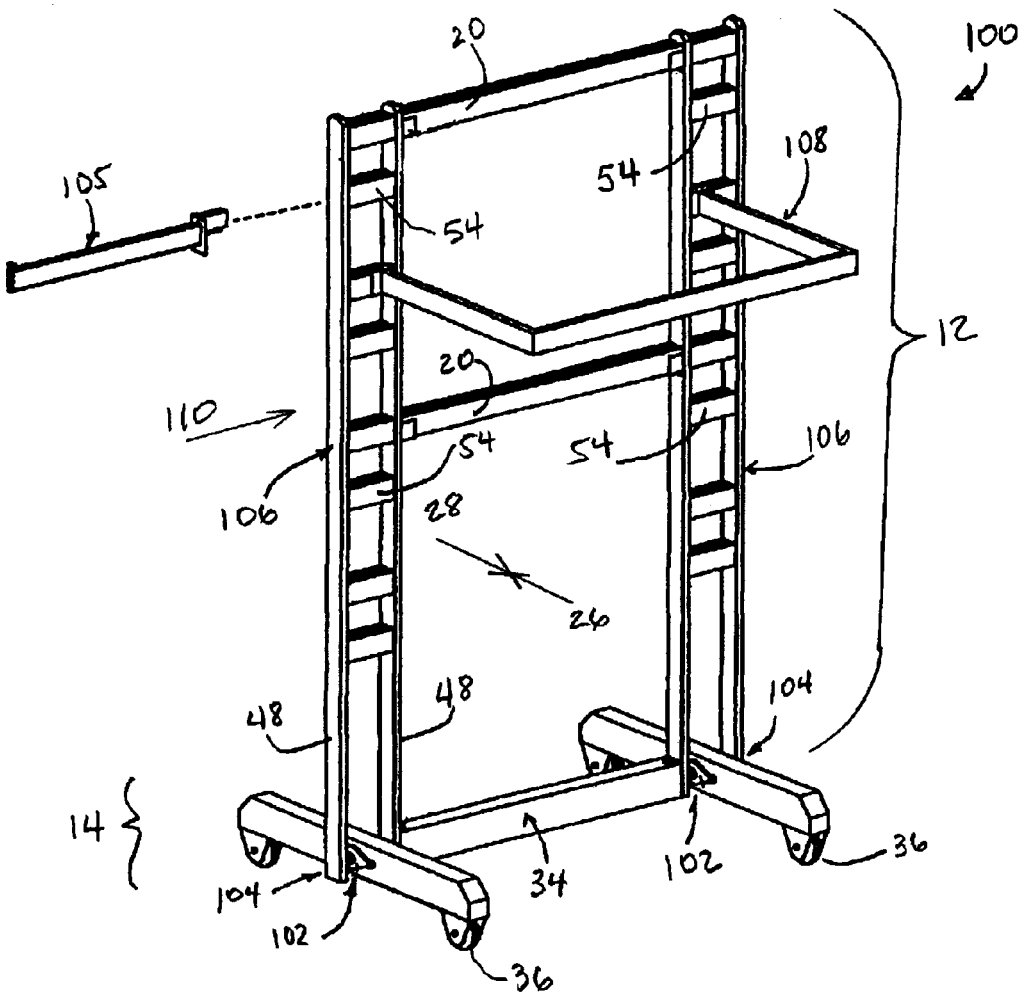
FIG. 20 is a semi-schematic perspective view of an alternative modular display rack provided in accordance with aspects of the present invention.

A modular display rack system 100 provided in accordance with other aspects of the present is shown in FIG. 20, which includes a lower base portion 14 having a quick connect/disconnect mechanism 102, and an upper base portion 12 having an attachment mechanism 104. The display rack system 100 is similar to the display rack system shown in FIGS. 2–4 in that it also includes end ladders 106 removeably secured to one another by a plurality of lateral support bars 20. The end ladders 106 are each formed by connecting a plurality of cross-braces 54 to two vertical braces 48. As before, peripheral connecting devices 105, 108 for hanging and displaying merchandise items may be attached to the display rack system 100 along a first side 26, a second side 28, or even a third side 110, which is perpendicular to the first and the second sides.

Figures 21A, 21B, 21C:
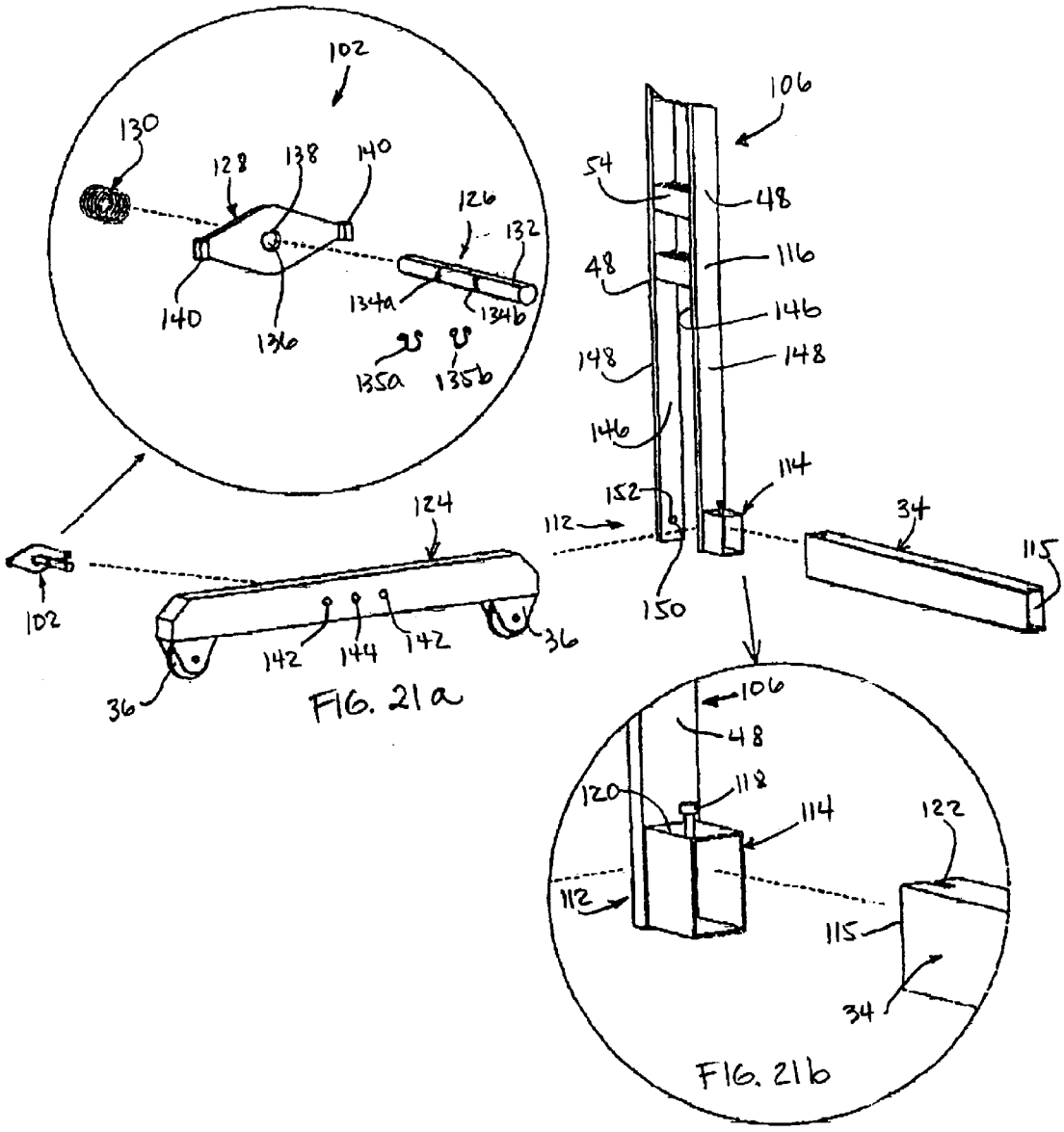
FIGS. 21*a*–21*c* are semi-schematic perspective views of a quick connect/disconnect mechanism used with the modular display rack of FIG. 20.

Referring now to FIG. 21*a*, a semi-schematic partial exploded view of the modular display rack system 100 of FIG. 20 is shown. The lower end section 112 of one of the end ladder racks 106 include a joining bracket 114 for joining one end of a cross bar 34, which then joins to another joining bracket of another end ladder rack 106 (or a center ladder rack) to form a display rack system (FIG. 20). In one exemplary embodiment, the joining bracket 114 is sized to be received in the opening 115 of the cross-bar 34, which telescopically mounts over the joining bracket 114 to engage therewith. The joining bracket 114 may comprise a rectangular tubing welded to a lower exterior surface 116 of the vertical brace 48, or to both vertical braces 48 for a center ladder rack, as further discussed below. Alternatively, a C-channel, an angle or L-channel, or other equivalent brackets may be used instead of the rectangular tubing for implementing the joining bracket 114.

Referring to FIG. 21*b* in addition to FIG. 21*a*, a fastener 118 is threadedly engaged to a first surface 120 of the joining bracket 114. More preferably, the fastener 118 projects through an opening on the first surface 120 of the joining bracket 114 and fastens to a nut (not shown). The nut may be welded subjacent the opening on an underside surface of the first surface 120. The cross-bar 34 may be joined to the joining bracket 114 by sliding the opening 115 of the cross-brace over the joining bracket and aligning a slot 122 positioned proximate the opening 115 around the fastener 118. The fastener 118 may then be fastened against the to suface of the cross bar 34 to secure the cross-bar with the joining bracket 114. For reference purposes, the lateral support bars 20 may be referred to herein as upper horizontal bars and the cross-bars 34 may be referred to herein as lower horizontal bars.

Referring now to FIG. 21*c* in addition to FIG. 21*a*, a quick connect/disconnect mechanism 102 is shown for securing a stabilizer bar 124 to an end ladder rack 106 (or to a center ladder rack). The quick connect/disconnect mechanism 102 comprises a locking pin 126, a locking flange 128, and a resilient member 130. In one exemplary embodiment, the locking pin 126 includes a longitudinal planar surface 132 extending the entire length of the locking pin and an optional pair of spaced part position locators or notches 134*a*, 134*b*. A pair of spring clips, C-clips, or hairpin clips 135*a*, 135*b* may be utilized to engage the notches 134*a*, 134*b* if incorporated, or directly to the locking pin to frictionally grip the surface of the locking pin, if not incorporated. The locking flange 128 includes a chamfered opening 136 sized to receive the locking pin 126 and may incorporate any number of shapes, including a rectangle, a rhombus, a square, etc. The chamfered opening 136 includes a planar section 138 sized to abut the longitudinal planar surface 132 of the locking pin 126 to eliminate relative rotation between the locking pin and the flange 128.

The locking flange 128 further includes a pair of male detents or tabs 140 for engaging a pair of locking apertures 142 of the stabilizer bar or base bar 124. The locking apertures 142 are positioned adjacent a central opening 144 of the stabilizer bar, which is adapted to receive the locking pin 126. The locking apertures 142 and the central opening 144 may extend the width of the stabilizer bar, i.e., are present on both surfaces of the stabilizer bar. The stabilizer bar 124 may include a pair of stationary or rotatable casters 36 for facilitating moving the modular display rack.

As previously discussed, the vertical braces 48 of the end ladder rack 106 (and of the center ladder rack, as further discussed below) may generally be made from rectangular tubing. The vertical braces 48 each comprises an inwardly facing surface 146 and an outwardly facing surface 148. For reference purposes, inwardly facing surfaces of a pair of adjacent vertical braces 48 (of either a center ladder rack or an end ladder rack) face one another. A retaining aperture 150 may be located at or near the lower end section 112 of each inwardly facing surface 146 of each vertical brace 48, but not on the outwardly facing surface 148 of the same vertical brace. The retaining aperture 150 comprises a chamfered opening and includes a planar section 152 sized to abut with the longitudinal planar surface 132 of the locking pin 126 to eliminate rotation of the locking pin relative to the vertical brace 48. However, it is envisioned that alternative quick connect/disconnect mechanisms may be made to operate with retaining apertures 150 positioned on the outwardly facing surfaces instead of or in addition to the inwardly facing surfaces of the vertical braces. For example, such retaining apertures may be incorporated to enable the locking pins to extend through the vertical braces.

The quick connect/disconnect mechanism 102 is mounted to the stabilizer bar 124 and the end ladder rack 106 by first inserting the locking pin 126 through the central opening 144 of the stabilizer bar 124. The locking pin 126 should be inserted so that the notches 134*a*, 134*b* on the locking pin 126 straddle either side (on the outside surface) of the stabilizer bar 124. The clips 135*a*, 135*b* are then engaged with the notches 134*a*, 134*b* on the locking pin 126 to confine the stabilizer bar 124 to an area between the two notches 134*a*, 134*b*, i.e., the stabilizer bar should be fixed axially along the locking pin between the notches.

The opening 136 on the flange 128 is then mounted over the locking pin 126, on either end of the locking pin until the male detents 140 on the flange engage the locking apertures 142 of the stabilizer bar 124. The resilient member 130 is now assembled over the end of the locking pin 126 on the end where the flange 128 is positioned. The quick connect/disconnect mechanism 102 and the stabilizer bar 124 are now assembled to the end ladder rack 106 by forcing the two ends of the locking pin into the retaining apertures 150 of the inwardly facing surfaces 146 of the vertical braces 48. The vertical braces 48 will momentarily and reversibly deflect or bend to enable the pin of the quick connect/disconnect mechanism 102 to be received by the retaining apertures 150 of the inwardly facing surfaces 146. Alternatively, a spring bias telescopic rod may be used for the locking pin 126, two or more resilient members 130 may be used instead of one, and a tongue and groove arrangement instead of a chamfered surface for rotational control of the components of the quick connect/disconnect mechanism may be used. Other variations for implementing a quick connect/disconnect mechanism are also contemplated and are deemed to fall within the scope of the present invention.

Figure 22:
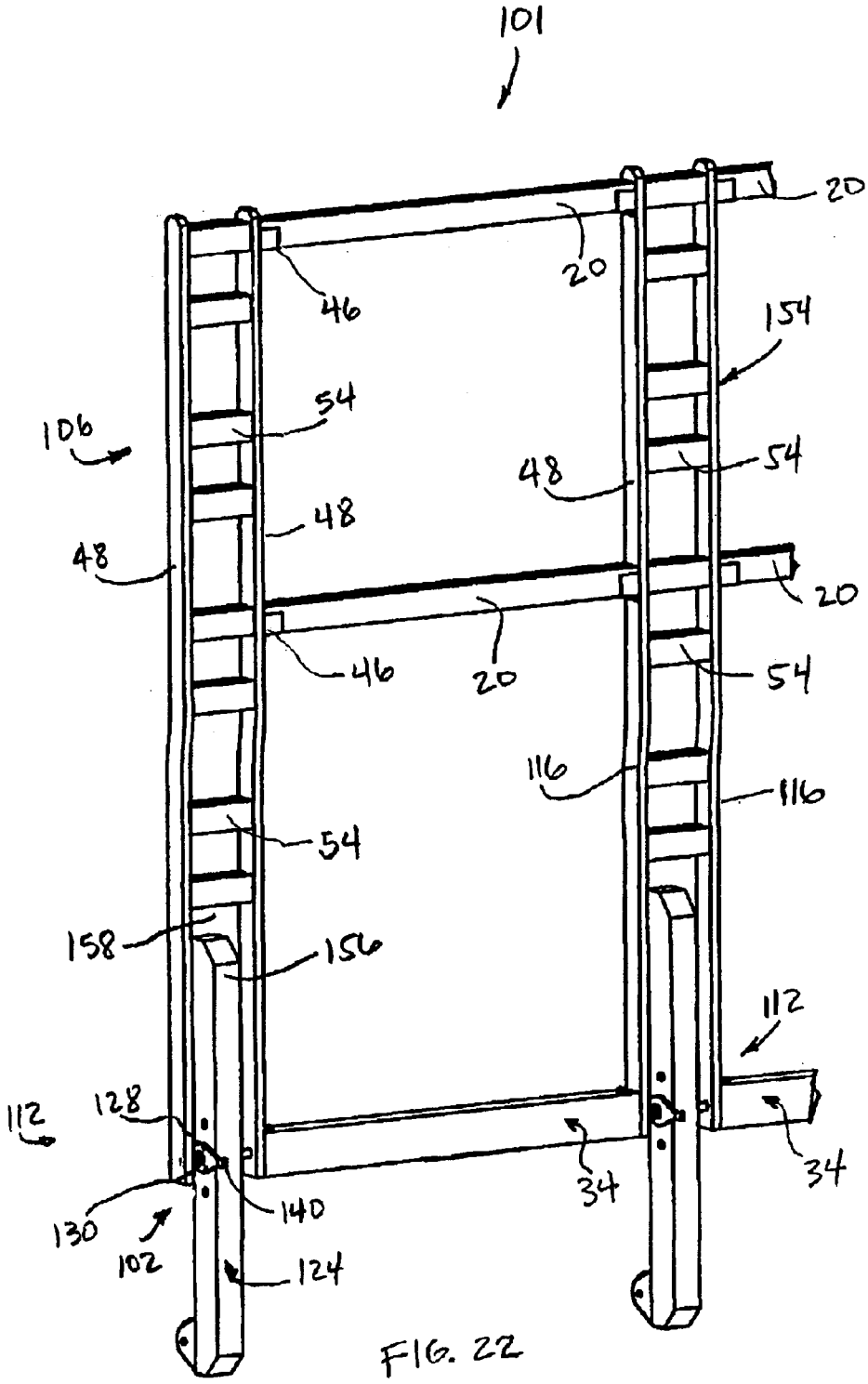
FIG. 22 is a semi-schematic perspective view of another alternative modular display rack provided in accordance with aspects of the present invention, which shows the quick connect/disconnect mechanism of FIGS. 21*a*–21*c* in a folded upright position.

Another modular display rack system 101 provided in accordance with aspects of the present invention is shown in FIG. 22, which incorporates the quick connect/disconnect mechanism 102 of FIGS. 21*a*–21*c*. The display rack system 101 comprises an end ladder rack 106 joined to a center ladder rack 154 by a plurality of lateral support bars 20 and a cross bar 34. The center ladder rack 154 is then connected to either an end ladder rack or another center ladder rack (not shown) via another set of lateral support bars 20 (partially shown) and cross bar 34 (partially shown). An end stabilizer bar 124 is connected to the lower end section 112 of the end ladder rack 106 and to the center ladder rack 154 using the quick connect/disconnect mechanism 102 of the present invention. The center ladder rack 154 differs from the end ladder rack 106 in that it has joining brackets 114 and U-shaped brackets 46 on the exterior surfaces 116 of both of its vertical braces 48. As previously discussed, there may be one or two U-shaped brackets 46 at each U-shaped bracket location.

In one embodiment, the end stabilizer bar 124 may be rotated from a first normal support position (FIG. 20) to a second folded upright position (FIG. 22). The rotation of the end stabilizer bar 124 from the first normal support position to the second folded upright position may be accomplished by moving the flange 128 to compress the resilient member 130. A finger gripping portion may be incorporated on the flange to facilitate manipulating the flange to compress the resilient member. The compression action causes the tabs 140 of the flange 128 to disengage from the locking apertures 142 of the stabilizer bar 124. The stabilizer bar 124 is then free to rotate about the locking pin, which acts as a pivot pin, until a bar end 156 is positioned in the folded space 158 of the end ladder rack 106 (or center ladder rack 154). The folded space 158 is defined by the lower most cross brace 54 and portions of the two vertical braces 48 near the lower end section 112 of either the end ladder rack or center ladder rack. The flange 128 may then be released and when released is urged by the resilient member 30 against the end stabilizer bar 124. The two tabs 140 of the flange now engage with the edges of end stabilizer bar 124 to maintain the end stabilizer bar in the second folded upright position. Alternatively, if the stabilizer bar 124 is in a first normal support position (FIG. 20), it may be moved to a second folded upright position (FIG. 22) in a reversed manner as discussed above.

The end stabilizer bar 124 may be attached to either the end ladder rack 106 and/or the center ladder rack 154 at the manufacturing plant and shipped to a retailer, a department store, or an end user in the folded upright position. Alternatively, the end stabilizer bar 124 and the quick connect/disconnect mechanism 102 may be shipped separately and assembled on site to use in the manner and fashion described in the foregoing paragraphs. To form the modular display rack system 101 of FIG. 22, a cross bar 34 may be mounted over a joining bracket 114 (FIGS. 21*a* and 21*b*) of the end ladder rack 106 and to one or more center ladder racks 154 to form a three or more modular tower display rack system. Lateral support bars 20 are then attached to adjacent U-shaped brackets 46 of adjacent ladder racks to provide lateral support to two adjacent ladder racks (i.e., to either two end ladder racks, two center ladder racks, or one end ladder and one center ladder rack).

Figure 23:
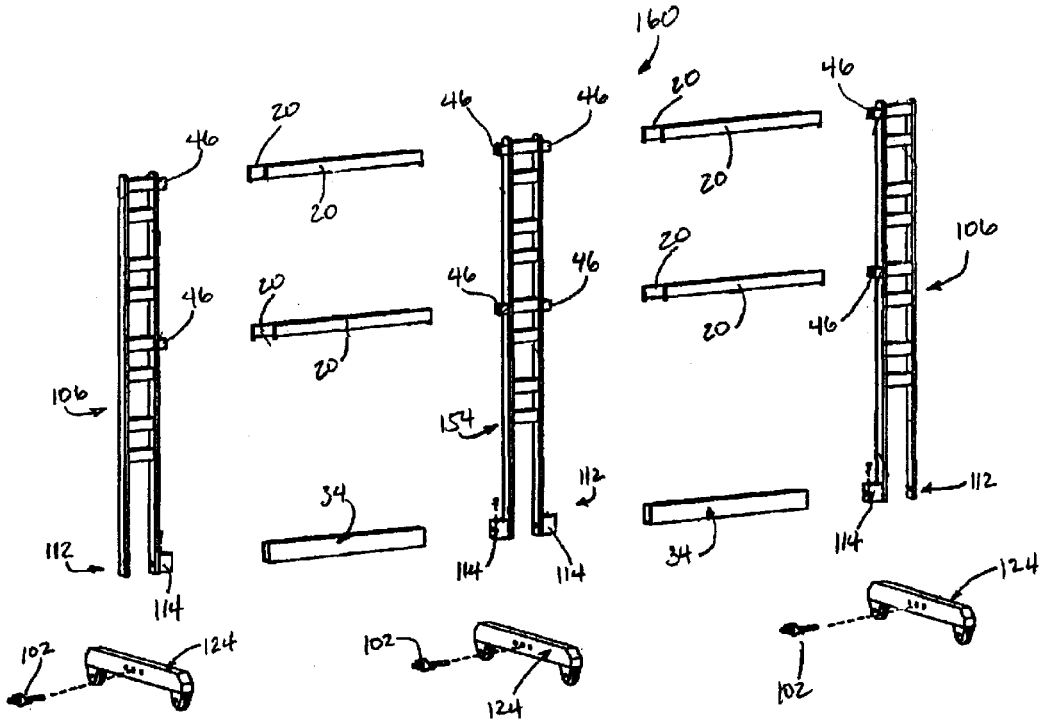
FIG. 23 is a semi-schematic exploded perspective view of a three tower modular rack system provided in accordance with aspects of the present invention.

FIG. 23 shows a semi-schematic exploded perspective view of a three tower modular display rack system 160 provided in accordance with aspects of the present invention. The modular display rack system 160 comprises two end ladder racks 106 and one center ladder rack 154. The two end ladder racks 106 may be removably joined to the center ladder rack 154 using two cross bars 34 to connect with the joining brackets 114 located near the lower end 112 of each of the ladder racks. Four sets of lateral support bars 20 are used to engage with 8 sets of U-shape brackets to support the ladder racks laterally, i.e., perpendicular to the height of the ladder racks. Each set of lateral support bars and U-shape brackets may comprise two lateral support bars and two U-shaped brackets or just one of each. End stabilizer bars 124 may be mounted to the lower end of the ladder racks 106, 154 to support the modular display rack system 160. The ladder racks 106, 154 may be supplied with the end stabilizer bars 124 mounted at the factory or separately installed on site, as previously discussed. In either scenario, the end stabilizer bars 124 must be rotated to the normal support position (FIG. 20) before the modular display rack may be used to display merchandise items.

Figure 24:
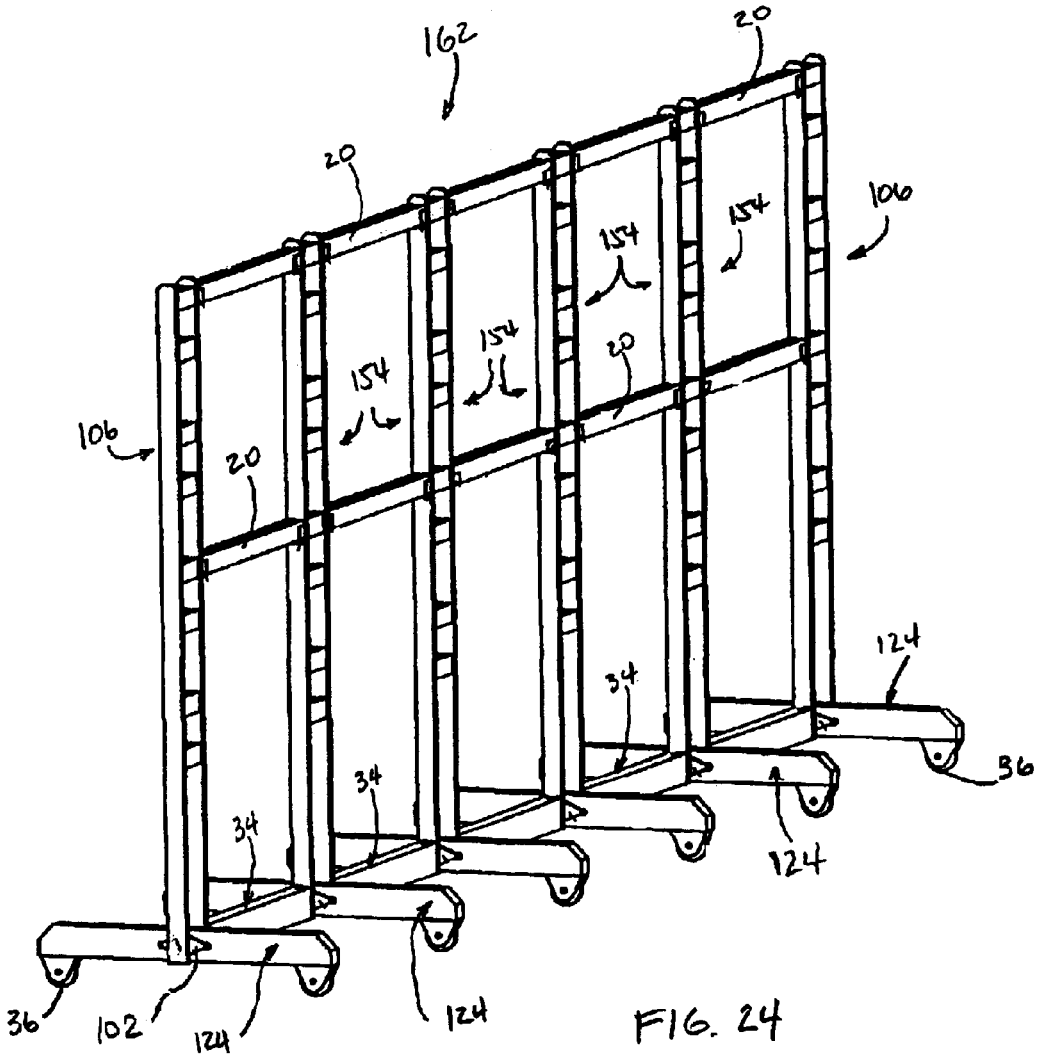
FIG. 24 is a semi-schematic perspective view of a six tower modular rack system provided in accordance with aspects of the present invention.

A semi-schematic perspective view of another modular display rack system 162 provided in accordance with aspects of the present invention is shown in FIG. 24. The display rack system 162 is similar to the display rack system 160 of FIG. 23 except that three additional center ladder racks 154 and corresponding number of cross bars 34, lateral support bars 20, and end stabilizer bars 124 are added to form the six ladder rack modular display rack system 162. Alternatively, fewer or more center ladder racks 154 may be added to decrease or increase the size of the modular display rack system.

Figure 25:
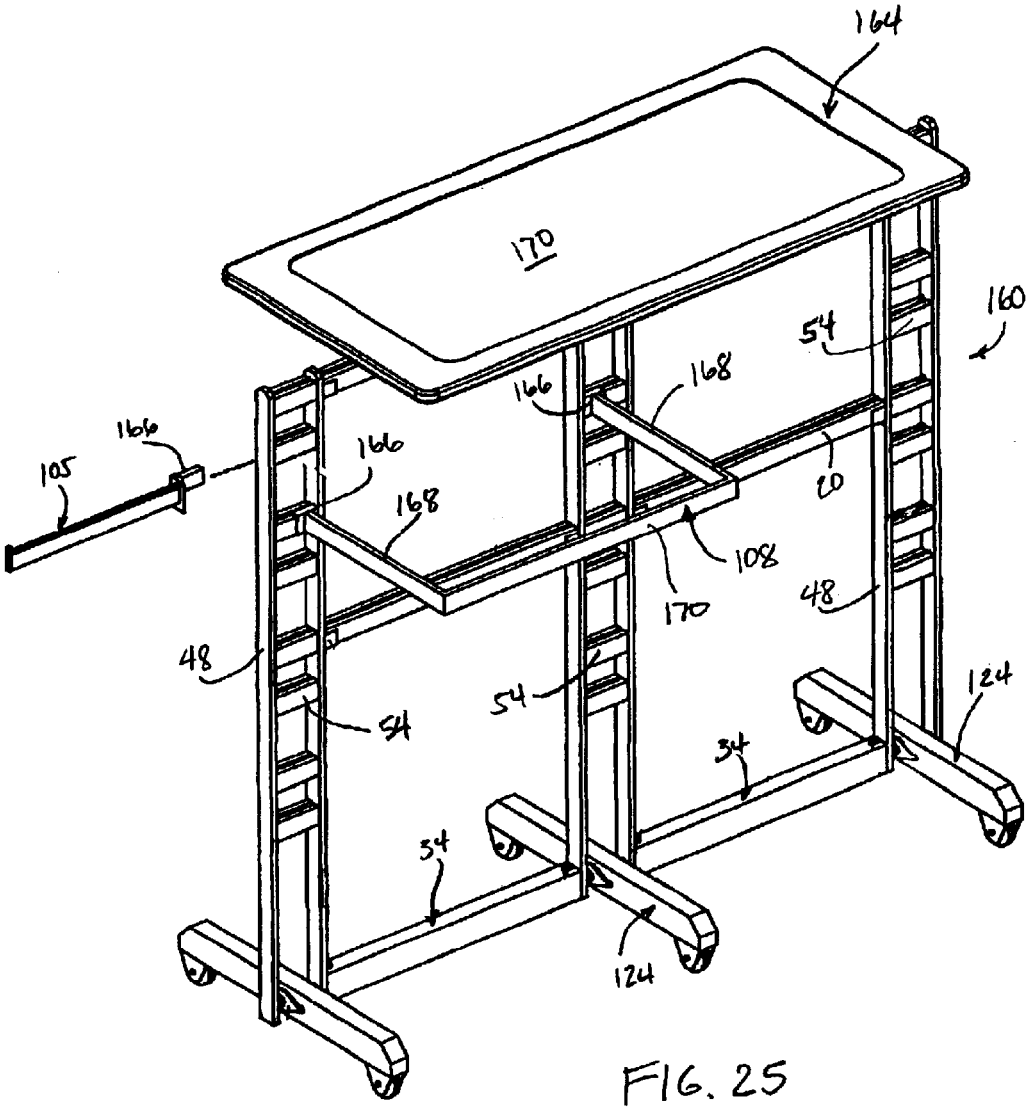
FIG. 25 is a semi-schematic partial exploded perspective view of the three tower modular rack system of FIG. 23 with a plurality of peripheral devices for displaying merchandise items.

The display rack system 160 of FIG. 23 is again shown in FIG. 25 along with several peripheral devices 105, 108, 164. One peripheral device can be a straight arm hangrail 105 having an engagement bracket 166 for engaging a vertical brace 48, a lateral support bar 20, or a cross brace 54. The straight arm hangrail 105 comprises a beam surface for hangers, hooks, and the like to hang on. Another peripheral device is a U-shaped hanging bracket 108. The U-shape hanging bracket 108 comprises two outwardly extending arms 168 connected to one another by a connecting arm 170 to form a U-shaped surface for hangers and the like to hang from. The ends of the outwardly extending arms 168 each comprises an engagement bracket 166 for engaging with a vertical brace 48, a lateral support bar 20, or a cross brace 54. The engaging brackets 166 may comprise C-channels and C-channels with notches and slots cut out in the walls of the channels to engage with the vertical brace 48, the lateral support bar 20, or the cross brace 54, or any combination thereof.

A peripheral device comprising a shelf 164 may also be used with the modular display rack system 160 of the present invention. The shelf 164 may comprise two or more engaging brackets 166 formed on the underside of the top shelf surface 170 to engage with either the vertical brace 48, the lateral support bar 20, or the cross brace 54. Once mounted, the shelf 164 may function as display surface for merchandise items, such as clothes, toys, food, etc. The shelf 164 may be made from steel, wood, thermoplastic, fiberglass, or other materials having sufficient hardness and rigidity to provide support for merchandise items.

Figure 26:
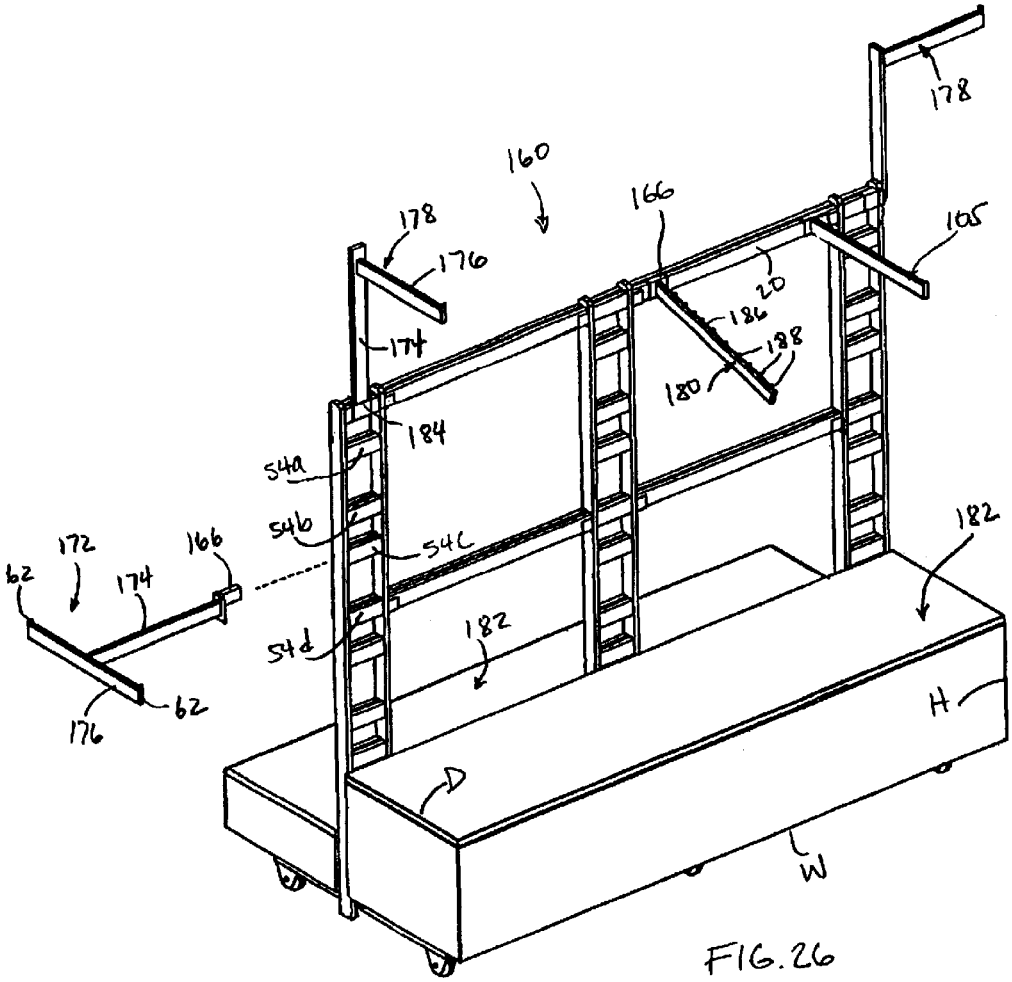
FIG. 26 is a semi-schematic partial exploded perspective view of the three tower modular rack system of FIG. 23 with a plurality of alternative peripheral devices for displaying merchandise items.

A semi-schematic perspective view of the modular display rack 160 of FIG. 25 is again shown in FIG. 26 with alternative peripheral devices. In one embodiment, the modular display rack system 160 may include one or more T-hangrails 172, one or more rising hangrails 178, one or more sloping arm hangrails 180, and one or more display boxes 182. The T-hangrail 172 shown comprises a first arm section 174 having an engaging bracket 166 attached to one end thereof and a second arm section 176 attached to the end opposite the engaging bracket. The ends of the second arm section 176 may include flanges 62 (See, e.g., FIGS. 9 and 10) to shield sharp edges of the second arm section and to provide a stop ledge for clothe hangers and hooks, i.e., to prevent the same from sliding off of the second arm section.

The rising hang rails 178 shown include a first arm section 174 having an axis attached to an engagement bracket 184 having a different axis. The axis of the first arm section 174 is offset from the axis of the engagement bracket 184 to enable the rising hangrail 178 to be hung from the second set of cross brace 54*a*, third set of cross brace 54*b*, and so forth. This offset configuration allows the rising hangrail 178 to be hung without the first arm section 174 or the second arm section 178 of the rising hangrail hitting or abutting any part of the tower rack or any part of the display tower, i.e., the offset provides clearance for the rising hangrail to be hung on any of the cross braces along the height of a particular ladder rack.

A sloping arm hangrail 180 may also be used with the modular display rack system 160 of the present invention. The sloping arm hangrail 180 comprises an arm section 186 attached to an engagement bracket 166, and more particularly to a side of the C-channel of the engagement bracket at an angle. The arm section 186 comprises a plurality of spaced apart bumps 188, which act to distribute hangers or hooks that are hung on the sloping arm hangrail 180 to prevent them from collecting together.

Display boxes 182 having a width W, a height H, and a depth D may also be used with the modular display rack system 160 of the present invention. The display boxes 182 may be made from wood, thermoplastic, thin sheet metal, and the like and attached to one or more stabilizer bars 124 to provide shelf space for merchandise items. The width D, height H, and depth D of the display boxes 182 may vary depending on needs and aesthetic appeal of the end user.

Figure 27:
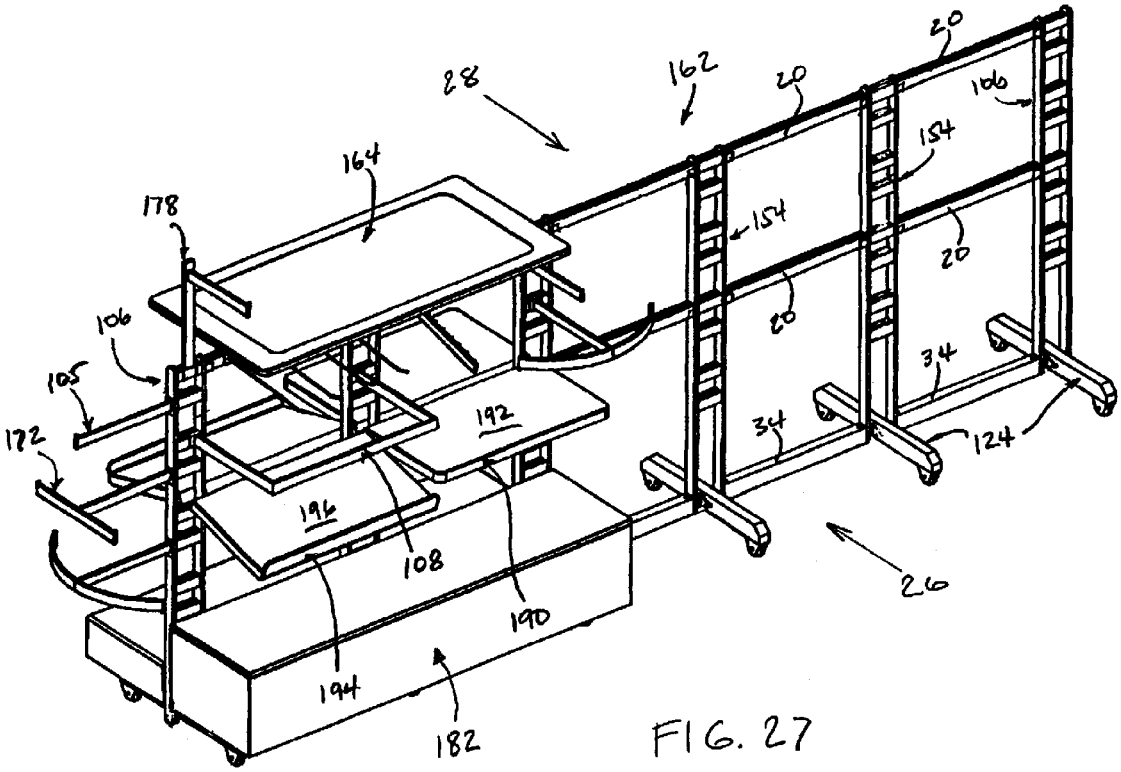
FIG. 27 is a semi-schematic perspective view of the six tower modular display rack system of FIG. 24 with a plurality of yet other alternative peripheral devices for displaying merchandise items.

A semi-schematic perspective view of the modular display rack 162 of FIG. 24 is shown in FIG. 27 with a plurality of peripheral devices mounted thereto for providing surfaces for displaying merchandise items. Although the plurality of peripheral devices are shown concentrated on the first three ladder racks, they may be mounted anywhere on the modular display rack system 162 in any fashion a user desires. For example, the peripheral devices may be spaced apart along the first side 26, the second side 28, or the third side 110 of the modular display rack and along all six tower racks 106, 154.

As shown, a U-shaped hanging bracket 108 is hung on a first side 26 of the modular display rack 162. The U-shaped hanging bracket 108 may also include a wire meshed basket hung on the frame of the U-shaped bracket to provide a pocket, such as a drawer, for displaying items, such as socks, packaged food, etc. Another peripheral device shown is a shelf hangrail 190 comprising a shelf surface 192 hung to either the cross braces 54 or lateral support bars 20 of the modular display rack system 162. An angled shelf hangrail 194 comprising a shelf surface 196 positioned at an angle to two or more engagement brackets (not shown) is also shown. As readily apparent, the particular peripheral devices shown are exemplary only and variations in the structures and the manner and fashion in which peripheral devices are used with the modular display racks of the present invention to display merchandise items are contemplated.

Listed below are exemplary rectangular tubing and bracket dimensions. However, it is understood that these are exemplary only and that other dimensions, thickness, etc. may be altered without changing the scope of the invention. Accordingly, a mere change in size or dimension is contemplated within the present invention.

Main vertical brace 48—1338 mm L×38 mm W×12.7 mm D

Cross-brace 54—102 mm L×34 mm W×12.7 mm D

Base bracket 58—4" L×1.5" W×1/16" –1/8" thick

U-shape bracket 46—25.4 mm L×40 mm W×17.2 mm D×2 mm thick

Lateral support bar 20—508 mm L×35.6 mm W×12.7 mm D

Flange 62—47.6 mm L×12.7 mm W×1/16" to 1/8" thick

Extended L-shape bracket 88—50.8 mm L×54.5 mm W (tall side)×36.6 mm D×19 mm W (short side)×1/16" to 1/8" thick Leg extension piece 82—282.5 mm L×60.2 mm W×40.6 mm D Center load bearing piece 80—127 mm L×60.2 mm W×406 mm D Tubing can have a range of 11—20 gauge, and where necessary 3/16" or even 1/4"

Although the preferred embodiments of the invention have been described with some specificity, the description and drawings set forth herein are not intended to be delimiting, and persons of ordinary skill in the art will understand that various modifications may be made to the embodiments discussed herein without departing from the scope of the invention, and all such changes and modifications are intended to be encompassed within the appended claims. Various changes to the modular display rack may be made including manufacturing the entire rack out of square tubing, changing the dimension of the tubing pieces, adding more or fewer cross-braces and U-shape brackets, changing the metallurgy, changing the finish (from nickel to grinded steel finish or brush steel finish), using posts instead of casters, and changing the type of casters. Other changes may also include using different means to practice the quick connect/disconnect mechanism disclosed herein, including using a spring loaded telescopic pivot pin, using two resilient members, using fewer or more clamps, etc. Accordingly, many alterations and modifications may be made by those having ordinary skill in the art without deviating from the spirit and scope of the invention.

What is claimed is:

1. A modular display rack system for displaying merchandise items comprising two ladder racks removably connected together by at least one horizontal bar, wherein the two ladder racks each comprises two vertical braces with each vertical brace comprising a side edge, wherein a base bar comprising a first end and a second end pivotally attaches to a lower end of the two vertical braces via a pivot pin such that the first end and the second end of the bar extend away from the lower end of the two vertical braces; and wherein the base bar is pivotable between a first position and a second position about the pivot pin.

2. The modular display rack system of claim 1, further comprising a third ladder rack removably attached to the first two ladder racks by a second at least one horizontal bar.

3. The modular display rack system of claim 1, further comprising a flange and a resilient member, both the flange and the resilient member are mountable over the pivot pin, and wherein the resilient member urges the flange against the base bar and the flange engages the base bar to fix the base bar from pivoting.

4. The modular display rack system of claim 1, further comprising means for limiting the base bar from pivoting.

5. The modular display rack system of claim 1, further comprising a plurality of sets of cross braces with each set comprising two individual cross-braces; wherein the plurality of sets of cross braces are connected to the two vertical braces of each ladder rack.

6. The modular display rack system of claim 1, wherein the at least one horizontal bar comprises an upper horizontal bar and a lower horizontal bar, wherein the upper horizontal bar comprises two ends and wherein each end comprises a flange and wherein each flange engages a receiving channel positioned on each of the ladder rack.

7. The modular display rack system of claim 1, further comprising plurality of peripheral devices removably attached to at least one of the ladder racks or the at least one horizontal bar.

8. A modular display rack system for displaying merchandise items comprising:

a first end ladder rack comprising a first vertical brace having an inwardly facing surface and an outwardly facing surface and a second vertical brace having an inwardly facing surface and an outwardly facing surface;

a plurality of cross braces connected to the inwardly facing surfaces of the first and second vertical braces of the first end ladder rack;

a retaining aperture located on a lower portion of the inwardly facing surface of each of the first and second vertical braces;

a blase bar for supporting the first end ladder rack pivotally attached to the retaining aperture of each of the first and second vertical braces via a pivot pin; the base bar is moveable between a first position and a second position about the pivot pin; and wherein the first end ladder rack is removably attached to a second end ladder rack or a center ladder rack by a support bar, the support bar supporting the first end ladder rack and either the second end ladder rack or the center ladder rack laterally.

9. The modular display rack system of claim 8, wherein the support bar comprises two engaging flanges on its two ends, and wherein each of the two engaging flanges engages with a receiving channel positioned on the outwardly facing surface of the first end ladder rack and an outwardly facing surface on either the second end ladder rack or the center ladder rack.

10. The modular display rack system of claim 8, wherein the plurality of cross braces connect with the inwardly facing surfaces of the first and second vertical braces of the first end ladder rack at a plurality of cross brace locations, and wherein each cross brace location comprises at least two individual cross braces.

11. The modular display rack system of claim 8, further comprising a flange and a resilient member, wherein the pivot pin passes through the flange and the resilient member, and wherein the resilient member urges the flange against the base bar.

12. The modular display rack system of claim 8, further comprising a peripheral device, the peripheral device comprising an arm device for supporting hangers and an engagement bracket positioned at an end of the arm device for removably attaching to the modular display rack system.

13. The modular display rack system of claim 8, further comprising a shelf peripheral device or a wire-meshed basket peripheral device removably attaching to the modular display rack system.

14. The modular display rack of claim 8, further comprising a second base bar pivotally attached to the either the second end ladder rack or the center ladder rack.

15. A method for erecting a modular display rack comprising:

attaching a first end ladder rack to either a second end ladder rack or center ladder rack using a support bar; the first end ladder rack comprising two vertical braces attached to one another by a plurality of cross braces;

moving a base bar comprising two ends pivotally attached to the end ladder rack via a pivot pin from a first position to a second position;

fixing the base bar from pivotally rotating from the second position; and wherein one of the two ends of the base bar moves from a spaced apart position from one of the cross braces to a closer position to the one of the cross braces when the base bar moves from the first position to the second position.

16. The method of claim 15, further comprising the step of attaching a cross brace to a lower portion of the first end ladder rack and either the second end ladder or the center ladder rack by sliding an opening at both ends of the cross brace over a joining bracket located on the lower portion of the first end ladder rack and either the second end ladder rack or the center ladder rack.

17. The method of claim 15, wherein the base bar is fixed from rotation by using a resilient member to urge a flange against the base bar, and wherein the flange comprises a tab engaging a locking aperture located on the base bar.

18. The method of claim 15, wherein the base bar is axially positioned on the pivot pin by a pair of clamp members.

19. The method of claim 15, wherein the base bar comprises at least two casters.

20. The method of claim 15, further comprising a peripheral device removably attached to the modular display rack for displaying merchandise items.

21. A modular display rack comprising:

an upper rack portion comprising at least two ladder racks, each ladder rack comprising two vertical braces attached to one another by a plurality of paired cross-braces; each paired cross-brace comprising two individual cross braces separated from one another by a gap;

a lower base portion comprising at least two stabilizer bars, each stabilizer bar comprising a top surface, a side surface, and a joining bracket attached proximate the aide surface;

a cross-bar fastened to the two joining brackets to secure the at least two stabilizer bars together;

a lateral support bar removably engaged to the at least two ladder racks to mechanically couple the at least two ladder racks to one mother, and wherein the at least two ladder racks are fastened to the at least two stabilizer bars to fasten the upper rack portion to the lower base portion.

22. The modular display rack of claim 21, wherein the cross-bar comprises a two open ends, wherein the two open ends are positioned over the joining brackets.

23. The modular display rack of claim 22, further comprising a plurality of fasteners, wherein the plurality of fasteners fasten the cross-bar to the joining brackets.

24. The modular display rack of claim 21, wherein at least one vertical brace of each ladder rack comprises at least one receiving channel comprising a base, two sides, and an open receiving slot.

25. The modular display rack of claim 24, wherein the lateral support bar comprises two end flanges with each end flange comprising an engagement tip.

26. The modular display rack of claim 25, wherein the two engagement tips of the lateral support bar engage the two open receiving slots of the at least two ladder racks.

27. The modular display rack of claim 21, wherein each stabilizer bar comprises and elongated bar section and a load bearing section positioned centrally of the elongated bar section.

28. The modular display rack of claim 27, wherein the joining bracket of each stabilizer bar is attached to the load bearing section.

* * * * *

UNITED STATES PATENT AND TRADEMARK OFFICE

CERTIFICATE OF CORRECTION

PATENT NO. : 6,935,523 B2
DATED : August 30, 2005
INVENTOR(S) : Ahn

It is certified that error appears in the above-identified patent and that said Letters Patent is hereby corrected as shown below:

Column 15,
Line 17, after “end of the”, insert -- base --.
Line 42, delete “rack”, insert -- racks --.
Line 60, delete “blase” insert -- base --.

Column 16,
Line 32, delete “to the either”, insert -- to either --.
Line 37, after “or”, insert -- a --.

Column 17,
Line 11, delete “aide”, insert -- side --.
Line 16, delete “mother”, insert -- another --.
Line 21, delete “a”.

Column 18,
Line 15, delete “and elongated”, insert -- an elongated --.

Signed and Sealed this

Fourteenth Day of March, 2006

JON W. DUDAS
*Director of the United States Patent and Trademark Office*